US005655655A

United States Patent [19]

Herzog

[11] Patent Number: 5,655,655

[45] Date of Patent: Aug. 12, 1997

[54] WRISTWATCH PACKAGE HAVING A HOLLOW BASE FOR RETAINING WATCH-RELATED LITERATURE

[76] Inventor: Jack Herzog, 5702 Durocher St., Montreal, Canada, H2V 3Y2

[21] Appl. No.: 681,208

[22] Filed: Jul. 23, 1996

[51] Int. Cl.[6] ..... B65D 85/40

[52] U.S. Cl. ..... 206/301; 206/477

[58] Field of Search ..... 206/301, 216, 206/477, 478

[56] References Cited

U.S. PATENT DOCUMENTS

| | | | |
|---|---|---|---|
| 4,082,183 | 4/1978 | Sturm | 206/301 |
| 4,216,858 | 8/1980 | Beauchamp | 206/301 |
| 4,830,181 | 5/1989 | Hartman | 206/301 |
| 5,181,608 | 1/1993 | Herzog | 206/301 |
| 5,377,822 | 1/1995 | Herzog | 206/301 |
| 5,383,552 | 1/1995 | Dikowitz | 206/301 |

*Primary Examiner*—Paul T. Sewell
*Assistant Examiner*—Nhan T. Lam
*Attorney, Agent, or Firm*—Pollock, Vande Sande & Priddy

[57] ABSTRACT

A wristwatch package has an elongated, substantially C-shaped element with slots formed adjacent its opposing ends. The straps of a wristwatch can be slipped into the slots to retain the wristwatch on the substantially C-shaped element without buckling the straps together. The C-shaped element is mounted on a hollow base having an interior tongue defining a region of varying dimension inside the base for receiving and securely retaining watch-related literature of different thicknesses inside the package.

8 Claims, 1 Drawing Sheet

WRISTWATCH PACKAGE HAVING A HOLLOW BASE FOR RETAINING WATCH-RELATED LITERATURE

FIELD OF THE INVENTION

The present invention relates to packages or boxes for wristwatches comprising an elongated watch support member mounted on a base adapted to receive and secure instructional or warranty pamphlets that typically accompany a wristwatch.

BACKGROUND OF THE INVENTION

Applicant's U.S. Pat. Nos. 5,181,608 and 5,377,822 disclose wristwatch packages with a substantially C-shaped support element. In the '608 patent, the support element includes a pair of integral clips disposed adjacent opposite end portions of the support element. A strap-type watch is mounted on the support element by slipping the straps of the watch into the clips obviating the necessity to buckle the straps together. In the '822 patent, the substantially C-shaped support element has an elongated central segment terminating in opposite end portions each of which has at least one slot formed therein for receiving the straps of a watch. Each slot opens into and extends from an edge of its associated end portion partially across that end portion in a direction transverse to the direction of elongation of the central segment. The length of each slot is greater than the width of a watchband to be supported in a package, and the width of each slot is greater than the strap thickness of any watchband that is likely to be supported in the package.

Both patented Herzog packages eliminate a number of disadvantages inherent in strap-type wristwatch support packages disclosed in the prior art, as described in the patents. Among other things, the patented Herzog packages can be inexpensively manufactured and allow a strap-type wristwatch to be held in position on the support member in a simple and expedient manner.

Warranty and/or instructional material is normally provided in the watch package, sometimes inserted loosely into the package, and in other cases inserted into an open base forming an integral portion of the package. Such materials tend to fall out of the packages when the package is used to display a watch, and materials that have been separated from their appropriate package are sometimes returned to a different, inappropriate package, or simply discarded to the disadvantage of the watch purchaser.

The present invention is an improvement on the wristwatch packages disclosed in the aforementioned Herzog '608 and '822 patents, the disclosures of which are incorporated herein by reference.

SUMMARY OF THE INVENTION

It is therefore an object of the invention to provide a wristwatch package that includes a support member taking the form of a substantially C-shaped element having at least two slots at each of its opposite end portions, for holding a strap-type wristwatch in place on the support member, and a base that includes a cavity for receiving watch-related pamphlets, the base being provided with a novel tongue arrangement for securely retaining the pamphlets in place.

It is another object of the invention to provide a wristwatch package that includes an integral base that defines an open cavity having an integral tongue therein for securely retaining watch-related pamphlets of various different thicknesses inside the package.

These and other objects, features and advantages are accomplished by the improvement in a wristwatch package for supporting and displaying a wristwatch having straps that are adapted to be buckled together when worn on the wrist of a user, without requiring that the straps be buckled together for purposes of such support and display. The wristwatch package includes a support member that comprises a substantially C-shaped element having an elongated central segment terminating in opposite end portions that are positionally displaced from the central segment, and a base integral with the support member. The substantially C-shaped element has at least two slots in each of the end portions, extending transverse to the direction of elongation of the central segment. Each of the two slots opens into an edge of its associated end portion. The slots are provided for holding the strap-type wristwatch in place on the support member by slipping each strap into the two slots at a given end of the support element.

Further improvement in the wristwatch package includes a hollow base with an opening for receiving watch-related literature, and an interior tongue for retaining the literature. The tongue is integral with the base, inclined to an upper interior surface of the hollow base, and provided with a plurality of upstanding ridges. This tongue configuration provides a region of varying height between the upper surface of the tongue and the adjacent interior upper surface of the hollow base, for receiving and retaining literature of varying thicknesses within the hollow base.

BRIEF DESCRIPTION OF THE DRAWINGS

The above-mentioned as well as additional advantages and features of the present invention will be evident and more clearly understood when considered in conjunction with the accompanying drawings, in which.

In all Figures, like reference numerals represent same or identical components of the present invention.

DESCRIPTION OF THE PREFERRED EMBODIMENT

Figure 1:
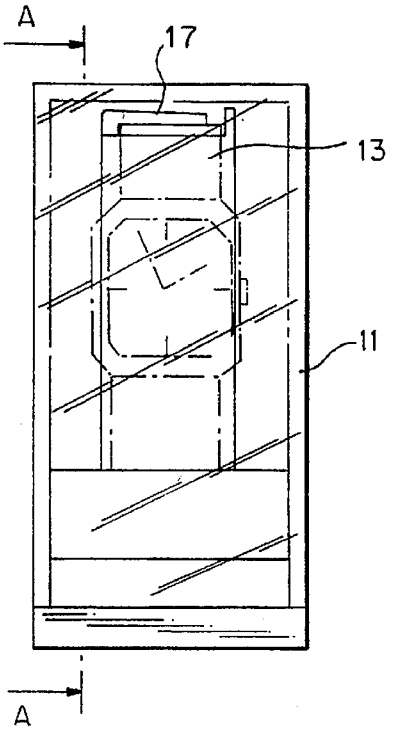
FIG. 1 shows a front view of a package constructed in accordance with one embodiment of the present invention.
Figure 2:
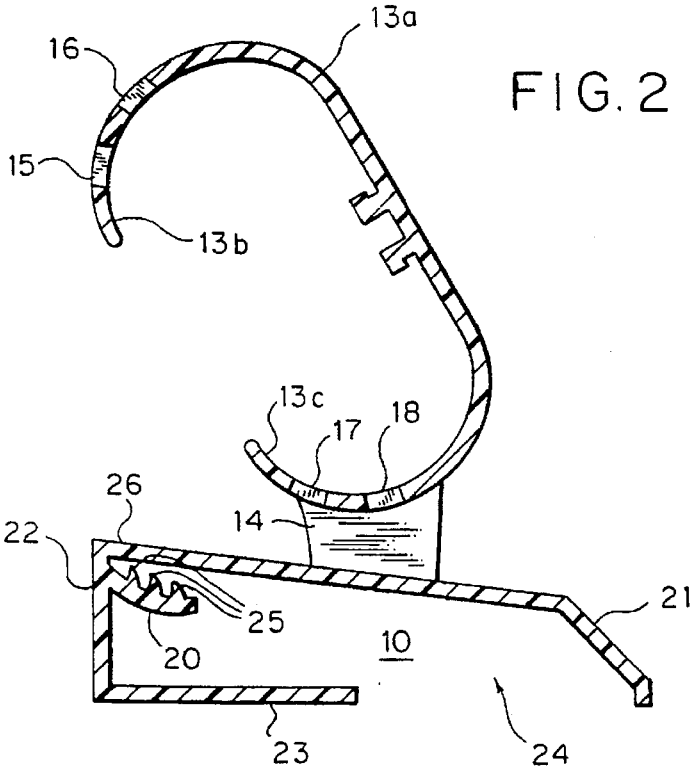
FIG. 2 is a side view of the actual embodiment of the FIG. 1 package taken along the line A—A of FIG. 1, without showing the wristwatch of FIG. 1.

FIGS. 1 and 2 show a preferred embodiment of the present invention. The wristwatch package includes base 10 that is adapted to receive box-like cover 11. Cover 11 is fabricated, for example, of a transparent plastic material that permits the contents of the package to be viewed while cover 11 is seated on base 10. Base 10 is integrated with a generally C-shaped support element 13 having an elongated central segment 13*a* merging at its opposite ends into a pair of end portions 13*b* and 13*c*. Substantially C-shaped element 13 is integrated with base 10 by web 14 that extends between substantially C-shaped element 13 and one side of end portion 13*c*. Base 10, support member 12, C-shaped support element 13 and web 14 may comprise different integral portions of a plastic member molded as a single unit. That is, a unitary plastic molding approach is employed in the preferred embodiment of the present invention.

A pair of spaced slots 15, 16 are provided in end portion 13*b*, and a similar pair of slots 17, 18 are provided in the other end portion 13*c*, into which the opposing straps of a strap-type wristwatch can be slipped to retain the wristwatch on substantially C-shaped element 13 without buckling the straps together. Each slot 15–18 opens into an edge of its associated end portion, extends partially across the end portion toward the other edge, and terminates in a smoothly curved interior end. The length of each slot is at least equal to, and preferably greater than, the width of the watchband that is to be inserted into the slots.

A wristwatch is supported in place by slipping the upper strap through slot 16 and then through slot 15, while the lower strap is slipped through slot 18 and then through slot 17. While the opposing ends may be disposed in an overlying position in relation to each other, the straps need not be buckled together to retain the watch in position on substantially C-shaped element 13.

Base 10 of the wristwatch package is shaped as a hollow, substantially 3-dimensional rectangle as clearly seen in FIG. 2. In the preferred embodiment, a front portion 21 of the rectangularly shaped base 10 is slightly slanted with respect to a bottom portion 23, while a rear portion 22 of base 10 is substantially vertical with respect to the bottom portion 23. The bottom portion 23 includes opening 24 through which various pamphlets or booklets are inserted for storage in the wristwatch package. These pamphlets, booklets or the like typically contain warranty information and instructional material on the operation of the wristwatch, as well known in the art.

The base includes an integral tongue 20 extending from the rear portion 22 toward the front portion 21 of base 10. Tongue 20, located in a substantially top part of the rear portion 22, curves at an angle toward, and then becomes substantially parallel with, the bottom portion 23 of base 10. In the preferred embodiment, base 10 is approximately 2 inches wide, tongue 20 is approximately 1 inch in width, centered between the vertical sides of base 10, and integrally formed with base 10 as a single molded plastic unit.

Several upstanding ridges 25 are formed on the top of tongue 20 facing the inside surface of ceiling portion 26 of base 10. Ridges 25 terminate in a vertical direction at different levels, i.e. , the tops of the ridges are spaced from ceiling portion 26 by varying amounts, the smallest spacing being between the ridge closest to rear portion 22 of the base and the spacing being successively increased outward of portion 22. A pamphlet is inserted through opening 24 between tongue 20 and the inside surface of the ceiling portion 26 until the pamphlet is grasped by an appropriate one of the ridges 25 dependent on the thickness of the pamphlet. Warranty or instructional information is thereby firmly secured in the wristwatch package.

In the prior art, warranty and instructions sheets often fall out of the package and get mixed up among various brands of wristwatches due to deficiencies in the packages. For example, as several wristwatch packages are opened and/or moved by a customer examining wristwatches for potential purchase, watch related literature may fall out of the packages and later put back into wrong boxes. The present invention overcomes this disadvantage by providing the above-disclosed inventive arrangement of attaching a pamphlet, typically accompanying a wristwatch, using easy, inexpensive and secure means.

Since those skilled in the art can modify the disclosed specific embodiment without departing from the spirit of the invention, it is, therefore, intended that the claims be interpreted to cover such modifications and equivalents.

What is claimed is:

1. A package for supporting and displaying a strap-type wristwatch that has a pair of straps, adapted to be buckled together when worn on the wrist of a user, without requiring that said straps be buckled together for purposes of support and display of the wristwatch in said package, said package including a substantially C-shaped element having an elongated central segment terminating in opposite end portions that are positionally displaced from said central segment, and a base integral with said substantially C-shaped element, said substantially C-shaped element including slots in said end portions, extending transverse to the direction of elongation of said central segment, each of said slots opening into an edge of its associated end portion and being provided to hold said strap-type wristwatch in place adjacent said substantially C-shaped element by slipping the watch straps into said slots, said base being hollow and including an opening for receiving watch-related literature, and said base also including an interior tongue extending from a rear interior surface of said hollow base in spaced relation to an interior ceiling portion of said hollow base, said tongue having a free end which is spaced from said interior ceiling portion of said base to define an inlet end of a region between the upper surface of said tongue and said interior ceiling portion into which watch-related literature can be inserted via said opening in said base for retaining the literature in place within said hollow base.

2. The package according to claim 1, wherein said upper surface of said tongue includes a plurality of ridges integrally formed thereon and extending toward said interior ceiling portion of said hollow base.

3. The package according to claim 2, wherein said ridges have top ends that are variably spaced from said interior ceiling portion of said hollow base.

4. A package for supporting and displaying a wristwatch, said package including a generally vertically oriented substantially C-shaped element on which a wristwatch can be removably mounted, and a base attached to said substantially C-shaped element, said base defining an interior cavity for the reception of watch-related literature, an opening in said base communicating with said cavity for insertion of literature into said cavity, and a tongue in said cavity, said tongue being attached at one end thereof to a generally vertical interior surface of said cavity and extending outwardly from said one end to a free end of said tongue that is adjacent to and spaced from a generally horizontal interior surface of said cavity to define a region of varying dimension between said tongue and said generally horizontal interior surface of said cavity for receiving and retaining literature inserted through said opening in place within said cavity.

5. The package of claim 4, wherein said generally horizontal interior surface of said cavity is an upper interior ceiling portion of said base.

6. The package of claim 4, wherein said tongue is disposed in at least partially inclined relation to said generally horizontal interior surface of said cavity, said ends of said tongue both being spaced apart from said horizontal interior surface, the spacing between said free end of said tongue and said generally horizontal interior surface being greater than the spacing between said one end of said tongue and said generally horizontal interior surface.

7. The package of claim 4, wherein said tongue includes a plurality of ridges extending toward said horizontal interior surface of said cavity from a surface of said tongue facing said horizontal interior surface, said ridges having free ends that are spaced apart from said horizontal interior surface.

8. The package of claim 7, wherein the free end of one of said ridges that is located adjacent said free end of said tongue is more widely spaced from said horizontal interior surface than the free end of one of said ridges that is located closer to said one end of said tongue.

* * * * *